US005524369A

United States Patent [19]

Phillips

[11] Patent Number: 5,524,369

[45] Date of Patent: Jun. 11, 1996

[54] SNOW REMOVAL DEVICE

[76] Inventor: Kent D. Phillips, R.D. #Box 2243 C, Stroudsburg, Pa. 18360

[21] Appl. No.: 317,704

[22] Filed: Oct. 4, 1994

[51] Int. Cl.[6] ..... E01H 5/02

[52] U.S. Cl. ..... 37/285; 37/266; 294/54.5

[58] Field of Search ..... 37/285, 284, 283, 37/278, 265, 266, 434; 294/54.5

[56] References Cited

U.S. PATENT DOCUMENTS

| | | | |
|---|---|---|---|
| 399,394 | 3/1889 | Fairweather . | |
| 1,927,196 | 9/1933 | Young | 37/266 |
| 2,603,892 | 7/1952 | Fischer | 37/16 |
| 3,091,790 | 6/1963 | Schroeder | 37/285 X |
| 3,483,643 | 12/1969 | Wenzel | 37/284 |
| 3,583,747 | 6/1971 | Lambert | 37/285 X |
| 3,727,964 | 4/1973 | Nordvik | 294/54 |
| 3,773,375 | 11/1973 | Nehls | 294/54 |
| 3,998,486 | 12/1976 | Mittelstadt | 37/285 |
| 4,024,654 | 5/1977 | Snyder | 37/53 |
| 4,249,767 | 2/1981 | Andreasen | 37/266 X |
| 4,253,257 | 3/1981 | Albert | 37/265 X |
| 4,264,095 | 4/1981 | Lemasters | 37/266 X |
| 4,386,474 | 6/1983 | Mechavich et al. | 37/285 |
| 4,531,713 | 7/1985 | Balboni | 254/131.5 |
| 4,550,943 | 11/1985 | Mirto | 294/54.5 |
| 4,729,199 | 3/1988 | Oller | 37/285 X |
| 5,083,388 | 1/1992 | Cooley | 37/285 X |

*Primary Examiner*—Terry Lee Melius
*Assistant Examiner*—Victor Batson
*Attorney, Agent, or Firm*—Eckert Seamans Cherin & Mellott

[57] ABSTRACT

A snow removal device permits a user to subdivide and then pull down sections of snow accumulated on a roof or other surface. An elongated handle supports an oppositely disposed blade and cutter, the cutter preferably having a taut wire between side struts attached to a top edge of the blade. The user draws the cutter through a section of snow, subdividing a rectangular slab of snow from the accumulated snow, then flips the device over and removes the slab with the blade. The cutter is generally perpendicular to the handle and the blade is inclined to lift the snow in the pulling direction. The cutter can be height adjustable and wheeled at the side struts, with the side struts shaped and coated for minimal friction. The handle can be length adjustable, e.g., by telescoping, and angularly adjustable or compactly collapsible via an articulation having complementary splines and groove for setting an articulation angle.

20 Claims, 3 Drawing Sheets

SNOW REMOVAL DEVICE

BACKGROUND OF THE INVENTION

1. Field of the Invention

The invention relates generally to snow removal tools, and more specifically, to a device useful to remove accumulated snow from a sloped roof of a building by subdividing a section of snow and then pulling the section over the edge of the roof.

2. Prior Art

Snow accumulated on a roof of a building can cause various problems. For example, heat transferred from the interior through the roof can partially melt snow on the roof, the runoff water refreezing at the eaves as icicles that can fall away. Ice built up at the eaves can get underneath roofing shingles, damaging the roof and possibly leaking water into the building. Accumulated snow and ice can suddenly cascade off the roof, especially a steep roof. Very heavy accumulations of snow on a roof in some cases can cause structural damage to a building.

It is therefore desirable to remove accumulated snow from a sloped roof before problems occur. A device for removing snow from a roof is disclosed in U.S. Pat. No. 3,773,375—Nehls, having a rectangular-shaped blade transversely fixed to the end of an elongated handle. A person on the ground manipulates the blade with the handle so that the blade digs into the snow at an elevation of the roof above the eaves. The operator pulls on the handle to urge the snow below the blade downwardly over the eaves.

A problem with this type of device is that, especially for heavy wet snow, there is a significant coefficient of static friction to be overcome. The snow near the surface tends to pack the snow near the roof. The snow in front of the blade adheres not only to the roof, but also to the adjacent snow that is not in the direct path of the blade. Pulling on the tool engages a downwardly spreading swath of snow. Instead of sliding down the slope of the roof in front of the blade, the snow tends to pack and to pile up in front of the blade, making it difficult to engage the blade closely along the roof surface. Packing of the snow produces even more static friction, exacerbating the problem.

It would be advantageous to structure a snow removal device for roofs and other surfaces that can overcome problems with static friction that result from the tendency of snow to pack and stick together.

SUMMARY OF THE INVENTION

An object of the invention is to provide a snow removal device that enables easier removal of snow from sloped roofs than prior art devices.

Another object of the invention is to provide a reversible snow removal device that includes a cutter for subdividing a slab from a layer of accumulated snow on a surface when the tool is arranged in one direction, enabling easy removal of the slab from the surface by flipping the tool and pulling the subdivided slab downwards with an attached blade.

Another object is to provide a snow removal device that reduces the static friction between the snow to be removed from a roof by the device and adjacent snow remaining on the roof.

These and other needs are met according to the invention in a snow removal tool that includes structure for cutting a slab generally along a path of the tool from a layer of accumulated snow, especially on a sloped-surface. A blade structure disposed opposite from the cutting structure is provided for pulling the slab along the surface, for example to urge the snow in successive adjacent slabs over the eaves of a building.

A generally rectangular-shaped blade is attached by a fitting to an elongated handle. The blade extends at an acute angle relative to the handle, from a front, first side of the blade, preferably with the handle attached at a point about mid-way between the side edges and near a top edge of the blade. A pair of side struts extend from the side edges of the blade, preferably at an obtuse angle relative to the first side and at an angle that is about 90° or less relative to the handle. A cutter such as a taut wire extends between distal ends of the side struts substantially parallel to the top edge of the blade. The cutter can have a high tensile strength, such as, for example, piano wire or guitar wire. The cutter, the side struts and the top edge of the blade together define a generally rectangular-shaped opening. When drawn along the roof, the cutter and side struts subdivide a slab of about the same size as the blade, making it easy to flip the tool over to the blade side and pull the slab away.

According to other aspects of the invention, the length of the handle can be adjusted to a desired length. A mechanism between a first section connecting to the fitting at the blade and a second section remote from the blade can be used to adjust an angle between the first and second sections of the handle. This permits the user to position the section attached to the handle parallel to the roof surface and the section grasped by the user at a steeper angle.

According to another aspect of the invention, the side struts are structured to reduce the drag force generated by pulling the struts through a layer of accumulated snow, for example having wheels. The struts can also be adapted for reducing friction between the strut and a roofing material.

According to another aspect of the invention, the spacing between the top edge of the blade and the wire can be adjustable to a desired spacing, for encompassing all or part of the depth of snow encountered.

To remove a layer of accumulated snow from a sloped roof, an operator holding the handle places the snow removal device, cutter side down, into the snow, for example at a position spaced from the bottom edge or eaves of the roof. The cutter and the side struts preferably are relatively thin and sink easily into the snow under the weight of the blade until the top edge of the blade is about at the top surface of the snow, and the blade extends upwardly. The operator pulls on the handle, e.g., in a direction parallel to the gradient of the roof, allowing the blade to skim over the top surface of the snow. This cuts an elongated, rectangular-shaped slab in the snow, corresponding to the size of the blade. The operator then flips over the tools and places the blade into the snow, for example at the upper edge of the cut slab. By pulling again on the handle in the same manner as before, the blade pulls the slab of snow, as a unit, in front of the blade's path and off the roof. This process is repeated until all the snow is removed.

The user can operate the tool in various fashions, not limited to strokes along the roof gradient and not limited to successive cutting and pulling passes. For example, the tool can cut in an upward stroke and pull in a downward stroke, or the user may wish to cut out a number of slabs before pulling away any of them.

The foregoing objects and aspects of the invention will be more fully understood from the following description of the invention with reference to exemplary embodiments as illustrated in the drawings appended hereto.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
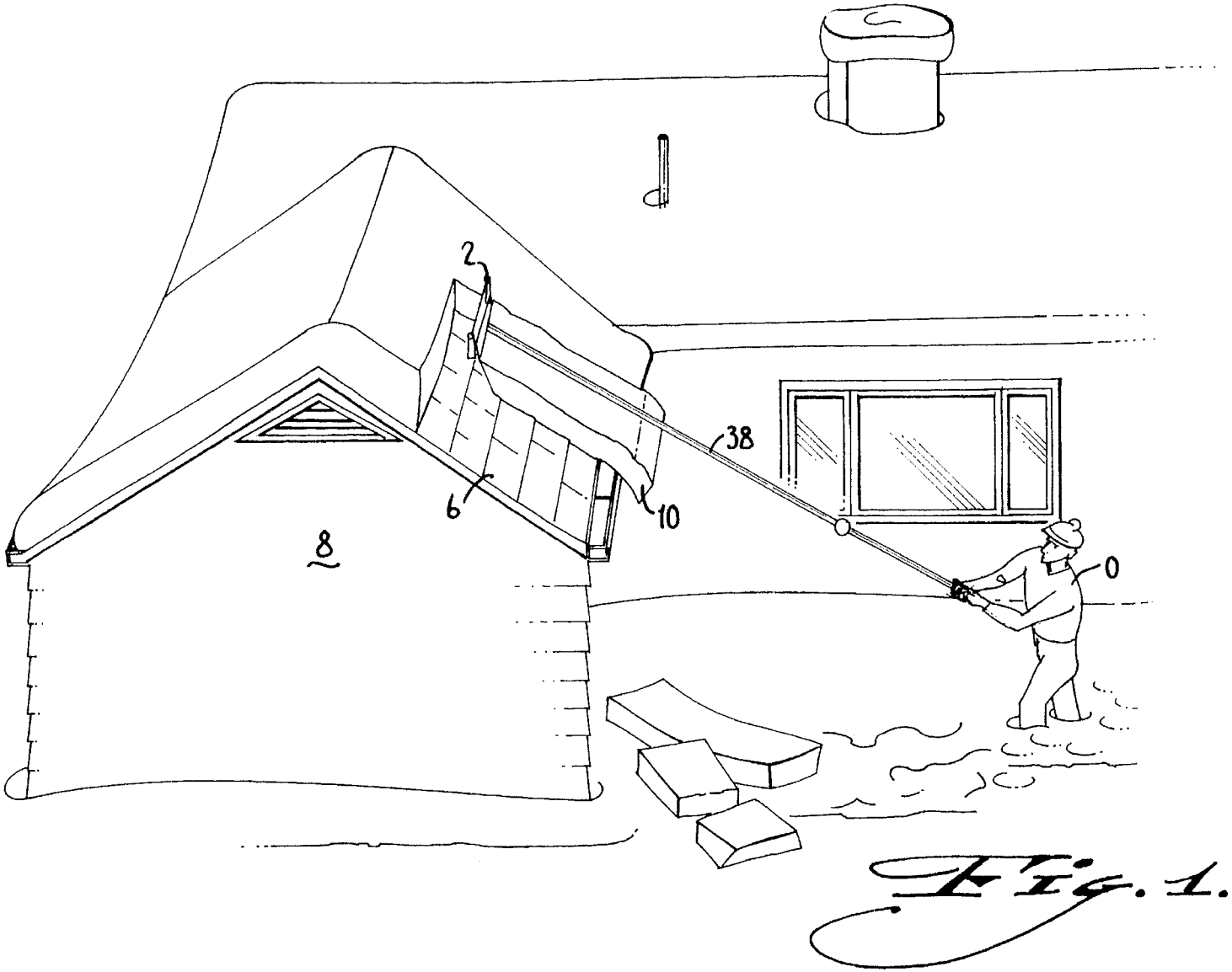
FIG. 1 is a perspective view of a snow removal device according to the invention, shown used to remove accumulated snow from a sloped roof top.
Figures 7, 8A, 8B, 8C:
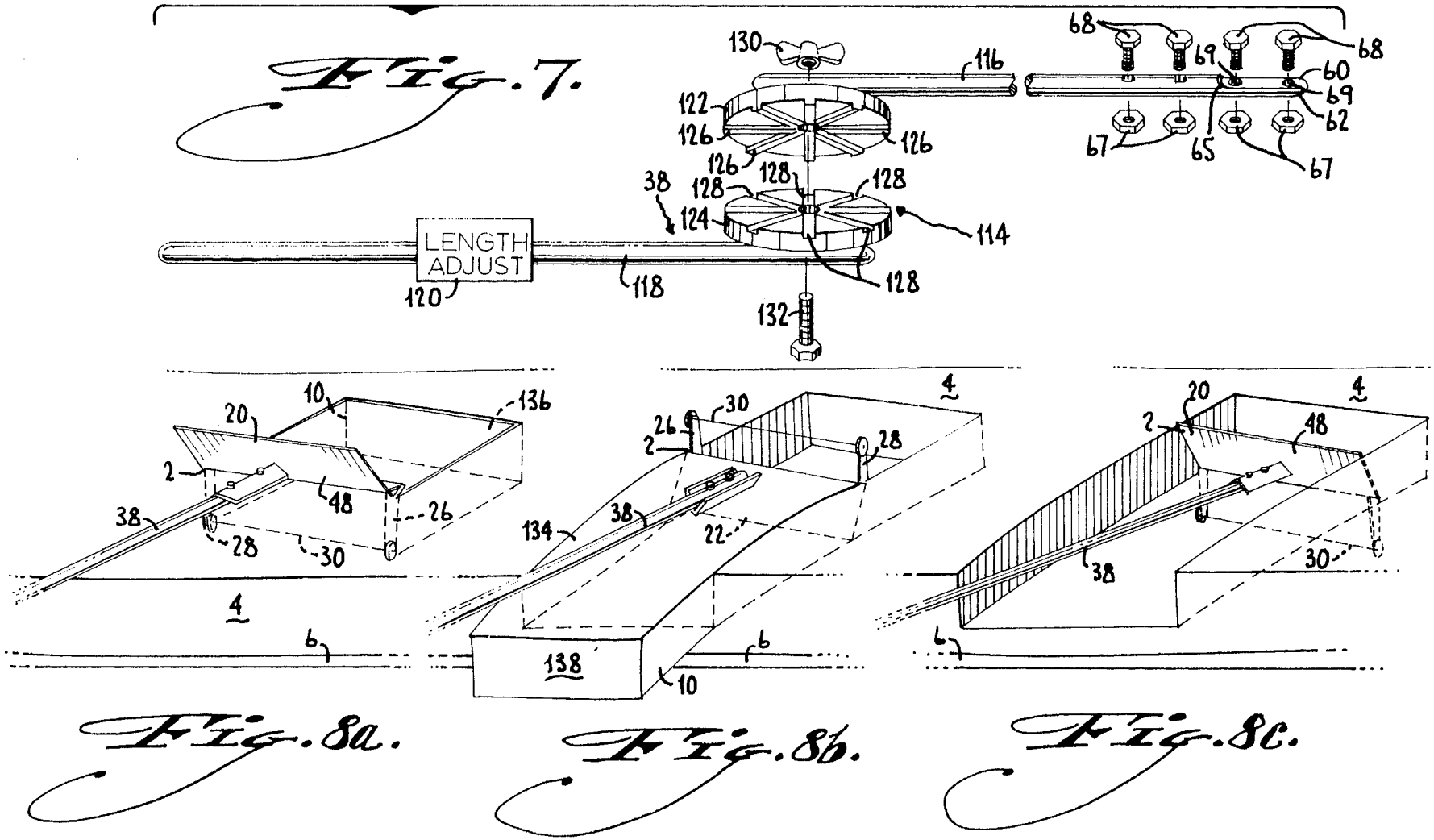
FIG. 7 is an exploded view of an adjustable length, articulated handle for use with the invention.
FIGS. 8*a*–8*c* illustrate exemplary uses of the invention.

FIG. 1 shows a person 0 using the snow removal device 2 of the invention to remove accumulated snow 4 from a sloped roof 6 of a building 8. The snow removal device 2, which is illustrated in greater detail in FIGS. 2–6, is adapted to remove the accumulated snow 4 from the rooftop 6 in a two-step process. The first step involves cutting a rectangular-shaped slab 10 in the accumulated snow 4 as illustrated in FIG. 8*a*. The second step involves pulling all or pan of the cut slab 10 off the rooftop 6, as shown in FIG. 8*b*. Whereas the cut slab is subdivided from the surrounding snow and partially disengaged from the roof, removing the snow is a much easier and more dependable procedure than simply attempting to pull down the snow with a blade.

Referring also to FIG. 2–7, wherein similar structures are indicated by uniform reference characters, the snow removal device 2 includes a substantially rectangular-shaped blade 20 for pulling the slab 10 along the rooftop 6. Two elongated side struts 26, 28 extend at an obtuse angle to the front face 22 of the blade 20, from near a top-edge 24 of the blade 20. A cutter 30 extends between the side struts 26, 28 parallel to the top edge 24 of the blade 20 and spaced from the top edge. Cutter 30 preferably comprises a taut wire for slicing through the accumulated snow 4 to subdivide the slab 10; however other structures are also possible, such as a thin strip of sheet metal.

A handle bracket 32 is attached about midway between the side edges 34, 36 of the blade 20, near the top edge 24 of the blade. The handle bracket 32 attaches an elongated handle 38 to the blade and cutter structure. The handle 38 extends at an angle $\alpha$ that is about 90° or less relative to the extension of the side struts 26, 28 and at an acute angle $\beta$ to the front face 22 of the blade 20.

In the preferred embodiment illustrated in the drawings, the handle bracket 32 is formed from two angle bars aligned perpendicular to one another with their interior angles facing each other. A first angle bar 40 includes a first plate 42 fastened to the top edge 24 of the blade 20, for example, by fasteners 44 such as rivets or nuts and bolts. A second plate 46 of the first angle bar 40, having a common edge with the first plate 42, extends perpendicularly outward from a rear face 48 of the blade. The ends 50, 52 of the first angle bar 40 preferably extend a short distance beyond the side edges 34, 36 of the blade 20 and support the side struts 26, 28, respectively. The second angle bar 54 extends through a hole 56 in the blade 20. First and second plates 58, 60 of the second angle bar 54 abut against the ends of the first and second plates 42, 46 of the first angle bar 40. The elongated handle 38, preferably including a notch 60 cut in an end 62, can then be nested securely against an interior angle surface 64 of the second angle bar 54, with the notched end 62 extending underneath the first angle bar 40 and a stop surface 65 of the notch 60 abutting against the first plate 42 of the first angle bar 40.

The handle 38 is attached to each of the first 40 and second angle bars 54 with fasteners, such as nuts 68 and bolts 67 extending through aligned holes 69 in the handle 38 and holes 70 in the first and second angle bars 40, 54. Other mechanical fastening means can also be used, such as rivets, pins, nails or threads.

Figures 2, 3, 4, 5, 6:
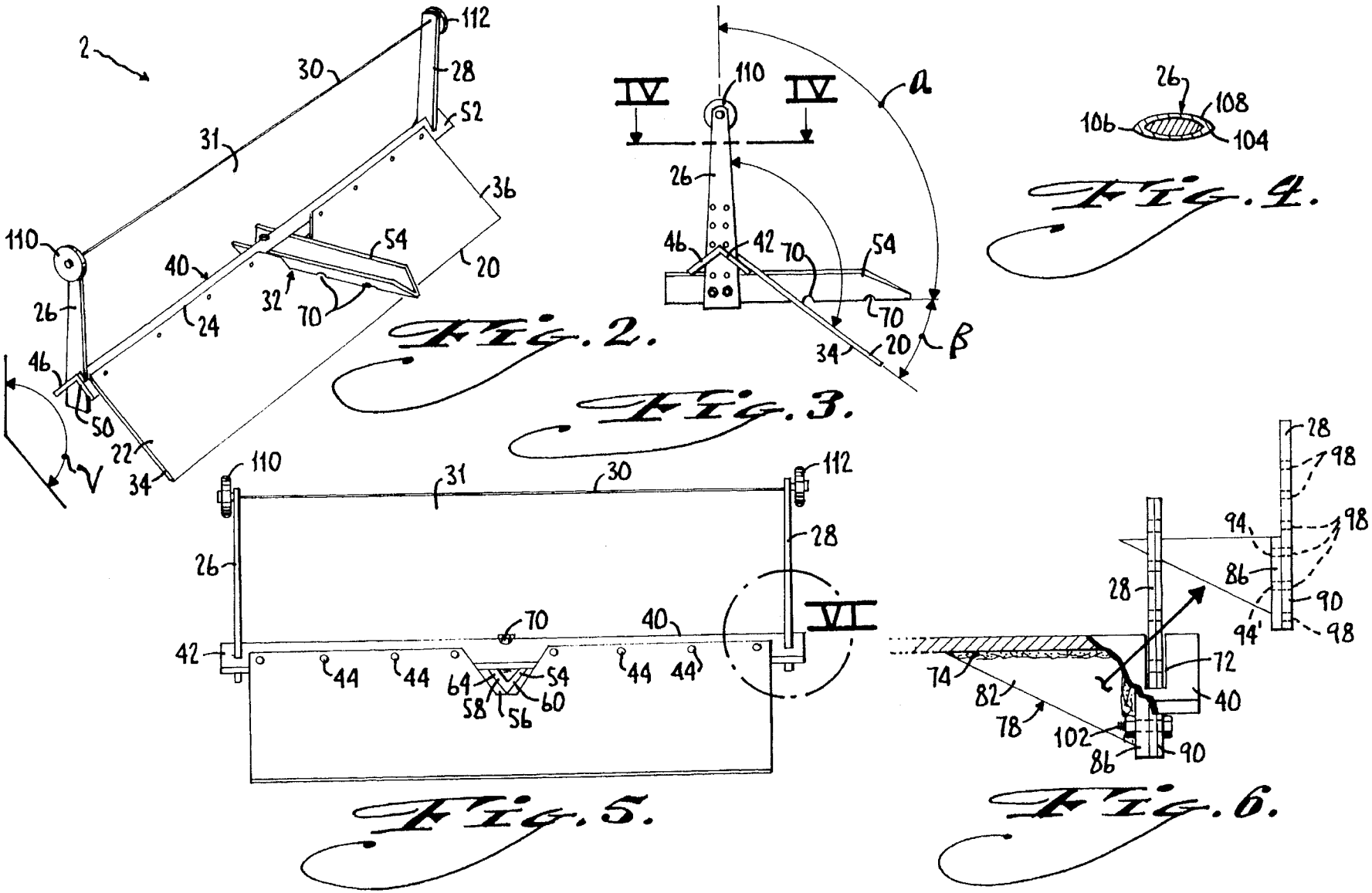
FIG. 2 is a perspective view of one embodiment of this invention.
FIG. 3 is a side elevation view of the device of FIG. 2.
FIG. 4 is a cross-sectional view along line 4—4 in FIG. 3.
FIG. 5 is a front elevation view of the device of FIG. 2.
FIG. 6 is a detail view in area 6 of FIG. 5.

The side struts 26, 28 preferably are shaped to cut easily through the accumulated snow 4, by presenting a small cross section in a direction parallel to the handle 38, as illustrated in FIG. 4. The side struts 26, 28 are affixed, for example, to the ends 50, 52, respectively of the first angle bar 40, and can be bolted, welded or similarly attached. In a preferred embodiment, each of the side struts 26, 28 (as shown with side strut 28 in FIG. 6) extends through a slot 72 cut through an end 74 of the first angle bar 40.

Continuing to refer to FIG. 6, a bracket 78 affixed to the first angle bar 40 by, for example, a weld or the like, includes a gusset 82. A plate 86 has an abutting bottom end 90 of the side strut 28. The bracket plate 86 has a pair of holes 94 for aligning with a selected pair of holes 98 in the side strut 28 such that the side strut 28 can be adjustably fastened to the plate 86 with fasteners 102, such as, for example, nuts and bolts. The distance between the cutter 30 and the top edge 24 of the blade 20 can be adjusted by selecting one of the pairs of holes 98 for fastening side strut 26 to plate 86. This feature permits an operator to cut slabs, having different thicknesses, which may be useful when the accumulated snow 4 is particularly heavy and/or deep.

The cutter 30 is preferably a small gauge, high-tensile strength wire, for example, piano wire or guitar string. The wire can be of lighter or heavier gauge, for example 0.010 to 0.050 inches diameter (0.25 to 1.25 mm). A thicker wire is more durable but also presents a larger cross section to resist cutting. A thicker wire also requires that the struts be relatively heavier to support it. Accordingly, a thin wire is preferred, together with means that position the wire slightly above the roof surface 6 to avoid abrasion by shingles, slate or the like.

The struts 26, 28, as noted hereinbefore, are preferably shaped to present a thin cross section to the accumulated snow 4 in the direction of a cutting stroke, i.e., parallel to the longitudinal extension of the handle 38. FIGS. 4 and 6 are cross sectional and elevation views of strut 26, which preferably has an oblate cross sectional shape with pointed ends 104, 106 facing in both the push and pull directions. Struts 26, 28 can include a surface fabricated of a material 108 having a low friction coefficient with snow, such as, for example, polytetrafluoroethelyne (Teflon®), or another non-stick surface material. The tips 110, 112 of the struts 26, 28 can also include rollers 114, 116 respectively, to enable low-friction rolling over the roof surface 6 and also to keep the cutter 30 spaced slightly from the roof surface during the cutting stroke.

The operator 0 holding the handle places the snow removal device, cutter side down, into an accumulated layer of snow on a sloped surface, such as a roof top, at a position spaced from the eaves. The cutter and the side struts either sink into the snow or are pushed into the snow until the ends of the struts are on the roof surface or until the top edge of the blade is about at the top surface of the snow. The operator then pulls down on the handle along the gradient of the roof, allowing the blade to skim over the top surface of the snow towards the eave. This cuts an elongated rectangular-shaped slab in the snow, having an indefinite length and a cross section equal to the opening between the top edge of the blade, the cutter wire, and the distance between the side struts.

The operator replaces the device in the snow, e.g., at the upper end of the cut slab, face with the blade side Of the device oriented down. By pulling on the handle in the same manner as before, the blade pulls the slab of snow, as a unit, in front of the blade's path and off the roof. This process is repeated until the snow is removed down to the roof surface and in laterally spaced sections to clear the roof.

The manner of operation of the device can be varied as desired, for example by cutting in an upstroke and pulling the blade in a downstroke. The tool can also be applied in directions other than along the roof gradient. The user may choose to execute a number of cutting strokes before flipping the tool to do blade strokes. As shown in FIG. 7, the handle 38 can be made in angularly adjustable articulated sections 117, 118, for example with the manually grasped section 118 having a length adjustment 120 such as a telescoping fitting. The other section 117 has an end 69 formed for attachment to the blade/cutter assembly via nuts and bolts 67, 68.

Handle sections 117, 118 are articulated by a fitting 115 having complementary splined plates 122, 124 that are urged together by butterfly nut 130 and bolt 132. Plates 122, 124 have mating splines 126 and grooves 128 defining relative angles between the proximal and distal handle sections 118, 117. By adjusting the tool such that section 117 is parallel to the roof surface and section 118 diverts downwardly at a steeper angle (in either the cutting or blade operating positions), the user can stand closer to the eaves than is possible with a straight handle arrangement.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A snow removal device, comprising:

cutter means on the device shaped for cutting a slab from a layer of accumulated snow on a surface by moving the device over the surface in a first pass; and means on the device for moving the slab from the surface in a second pass, including a blade operable to engage the slab, with the first and second passes moving in a same direction.

2. The snow removal device of claim 1, wherein the first and second passes both move in a downward direction.

3. The snow removal device of claim 2, wherein the means for moving the slab comprises a generally rectangular-shaped blade having a top edge, a bottom edge spaced from the top edge, and laterally spaced side edges, and a bracket for rigidly coupling a handle to a front side of the blade such that the handle projects from the blade, and wherein the cutter means comprises a pair of generally parallel, side struts fixed to the blade.

4. The snow removal device of claim, 3, wherein the side struts extend at an obtuse angle relative to the blade, wherein the spacing between the side struts is at least as large as the spacing between the side edges of the blade, and a cutter extending between the side struts and aligned generally parallel to the top edge of the blade, whereby the cutter, the side struts and the top edge define a generally rectangular-shaped opening for defining the slab.

5. The snow removal device of claim 2, wherein the side struts and the handle define an angle that is no more than about 90°, and wherein the handle and the front side define an acute angle.

6. The snow removal device of claim 2, further comprising means for adjusting a distance between the cutter means and the top edge of the blade.

7. The snow removal device of claim 2, wherein the cutter means comprises a wire extending between the side struts.

8. The snow removal device of claim 2, wherein the struts include means for reducing a drag force generated when moving the device in the first pass through a layer of snow.

9. The snow removal device of claim 8, wherein the means for reducing the drag force comprises a low friction coefficient coating on an outer surface of each of the struts.

10. The snow removal device of claim 8, wherein the means for reducing the drag force comprises wheels on the struts for riding along the surface.

11. The snow removal device of claim 8, wherein the means for reducing the drag force comprises each of the struts being generally pointed at least along one edge to cut through the layer of snow.

12. The snow removal device of claim 2, wherein the bracket fixes an end of the handle at a position about mid-way between the side edges and proximate to the top edge.

13. The snow removal device of claim 2, wherein the bracket includes:

a first angle bar including first and second plates connected at a common edge and defining a bar angle, wherein the first plate is fastened to the blade near the top edge and the second leg extends outward from near a rear face of the blade;

a second angle bar including first and second plates connected at a common edge and defining a bar angle, wherein the second angle bar extends through a hole defined by the blade about perpendicular to the first angle bar, the peripheral edges of the first and second plates of the second angle bar fitting into slots defined by the first and second plates of the first angle bar;

means for securing the first and second angle bars together; and, means for securing the elongated handle in a position nested against the first and second plates of the second angle bar.

14. The snow removal device of claim 1, wherein the cutter means and the blade are arranged to extend substantially in opposite directions such that the slab can be cut in the first pass with the cutter proximate the surface, whereupon the device is flipped over, and the slab can be moved from the surface in the second pass.

15. A snow removal device for removing accumulated snow from a generally flat surface, comprising:

a generally rectangular-shaped blade, including a top edge, a bottom edge spaced from the top edge, and spaced apart side edges;

a bracket for rigidly coupling a handle to a front side of the blade and projecting outward therefrom at a position about mid-way between the side edges and proximate to the top edge;

a pair of side struts fixed to the blade and extending from the top edge at an obtuse angle from the front side, wherein the spacing between the side struts is at least as large as the spacing between the side edges of the blade, wherein the side struts and the handle define an angle that is no more than about 90°, and wherein the handle and the front side define an acute angle; and a wire connected to each of the side struts and aligned generally parallel to the top edge, such that the wire, the side struts and the top edge define a generally rectangular-shaped opening such that a generally rectangular-shaped slab of snow can be cut by pulling the device by the handle through a layer of snow, and wherein the struts each include means for reducing a drag force generated by moving the struts through a layer of snow.

16. The snow removal device of claim 15, further comprising means for adjusting a distance between the wire and the top edge.

17. The snow removal device of claim 16, wherein the means for reducing the drag force comprises a low friction coefficient coating on an outer surface of each strut.

18. The snow removal device of claim 16, wherein the means for reducing the drag force comprises each strut being generally pointed at least at a forward edge to cut through the layer of snow.

19. The snow removal device of claim 16, further comprising means for adjusting a length of the handle.

20. The snow removal device of claim 16, further comprising an articulation between a first section of the handle proximate the blade and a second section of the handle remote from the blade, the articulation comprising means for adjustably fixing an angle defined between the first section and the second section.

* * * * *